United States Patent [19]

Morsey

[11] Patent Number: 4,710,990

[45] Date of Patent: Dec. 8, 1987

[54] AIR-WATER NOZZLE FOR A SPA TANK

[76] Inventor: Donald M. Morsey, 2121 Carlotta Dr., Sacramento, Calif. 95825

[21] Appl. No.: 17,956

[22] Filed: Feb. 24, 1987

[51] Int. Cl.[4] ..... A61H 33/02

[52] U.S. Cl. ..... 4/542; 4/492

[58] Field of Search ..... 239/251, 428.5; 128/66; 261/DIG. 75

[56] References Cited

U.S. PATENT DOCUMENTS

| | | | |
|---|---|---|---|
| 2,381,740 | 8/1945 | Grelson | 239/251 X |
| 3,428,131 | 2/1969 | Winslow | 239/251 X |
| 3,441,086 | 4/1969 | Barnes | 239/251 X |
| 4,029,724 | 6/1977 | Muller et al. | 261/DIG. 75 X |
| 4,220,145 | 9/1980 | Stamp et al. | 4/542 X |
| 4,523,340 | 6/1985 | Watkins | 4/542 |

*Primary Examiner*—Charles E. Phillips

*Attorney, Agent, or Firm*—Lothrop & West

[57] ABSTRACT

A partially housed air-water rotor is mounted for rotation about a horizontal axis. A water pipe on the axis serves as one bearing for the rotor, while an air pipe on the axis serves as another bearing for the rotor. The rotor ends have nozzles effective to mix the air and water and to direct discharge thereof in opposite tangential directions in a plane normal to the axis and from said housing through a vertical slit in the side of a spa tank.

6 Claims, 10 Drawing Figures

FIG-3
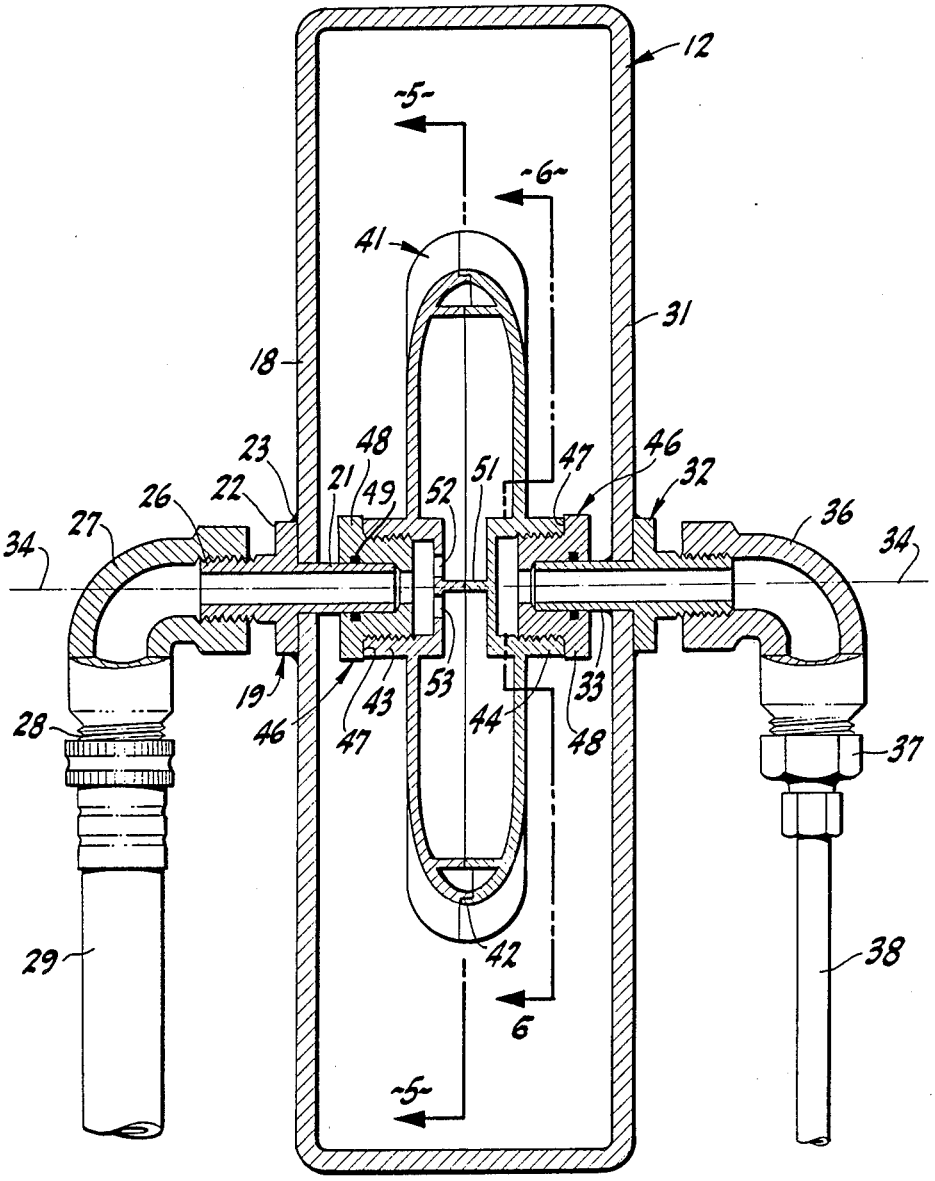
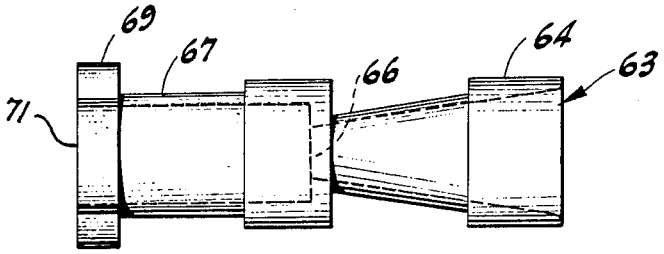
FIG-4

FIG-7
FIG-5
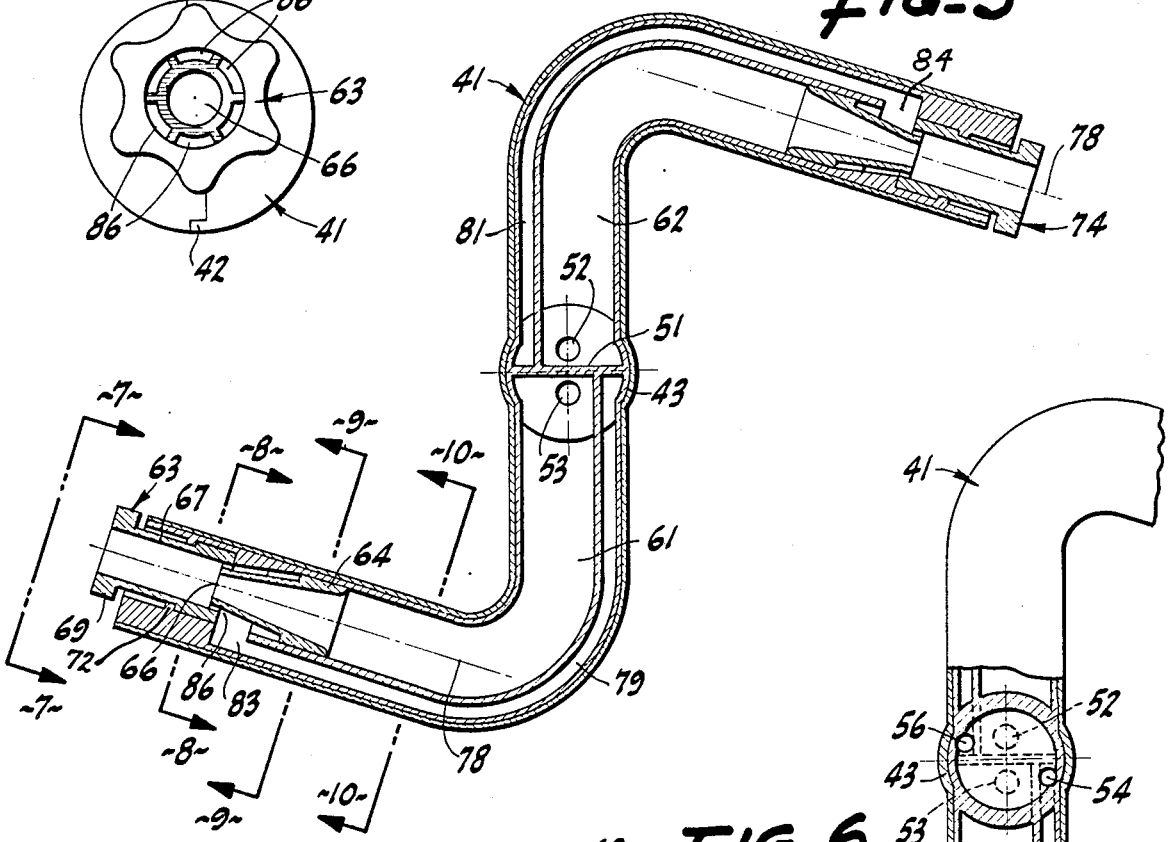
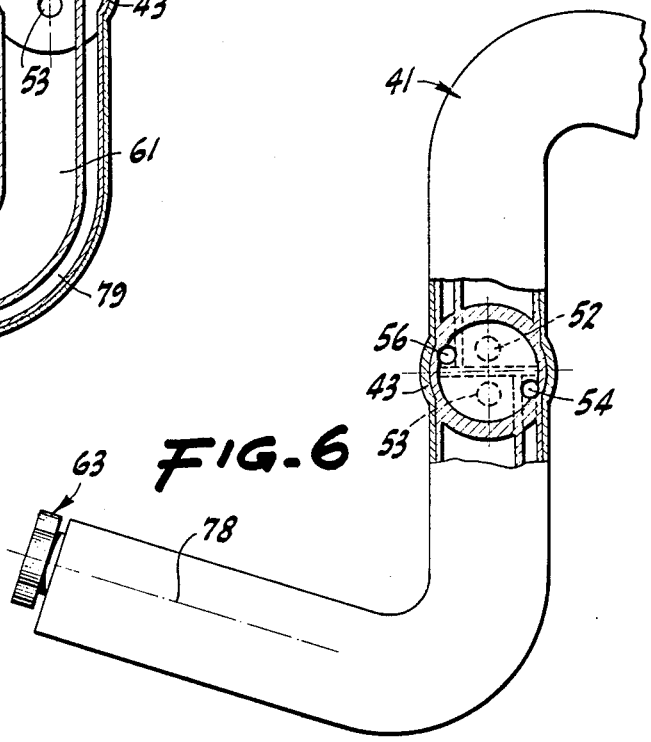
FIG-6
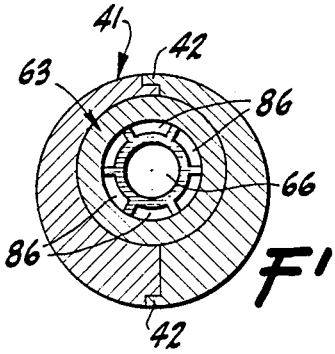
FIG-8
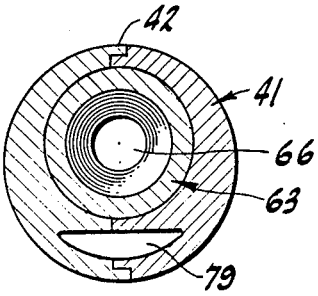
FIG-9
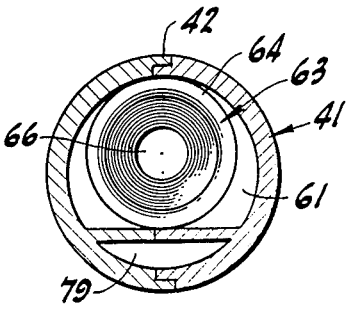
FIG-10

AIR-WATER NOZZLE FOR A SPA TANK

BRIEF SUMMARY OF THE INVENTION

A housing is open to a slit in the wall of a spa tank. A rotor is mounted in the housing to turn about a horizontal axis on a bearing also leading in water and another bearing also leading in air. The rotor is S-shaped and discharges a mixture of air and water from the ends thereof in a plane normal to the horizontal axis and through the slit into the spa tank.

BACKGROUND OF THE INVENTION

Water-containing small spa tanks have come into wide use. To augment and enhance the benefits and pleasures of the spa user or users, it is desirable to afford a tactile and massaging function. The present invention does that.

BRIEF DESCRIPTION OF THE DRAWINGS

FIG. 3 is a cross-section, the plane of which is indicated by the line 3—3 of FIG. 2.

FIG. 4 is a side elevation of a nozzle subassembly.

FIG. 5 is a central cross-section of the rotor shown in FIG. 2.

FIG. 6 is a side elevation of the rotor, portions being broken away to reduce the size of the figure and to show the interior construction in cross-section on a substantially median plane.

FIG. 7 is an end elevation of one end of the rotor.

FIG. 8 is a cross-section, the plane of which is indicated by the line 8—8 of FIG. 5.

FIG. 9 is a cross-section, the plane of which is indicated by the line 9—9 of FIG. 5.

FIG. 10 is a cross-section, the plane of which is indicated by the line 10—10 of FIG. 5.

DETAILED DESCRIPTION

Figure 1:
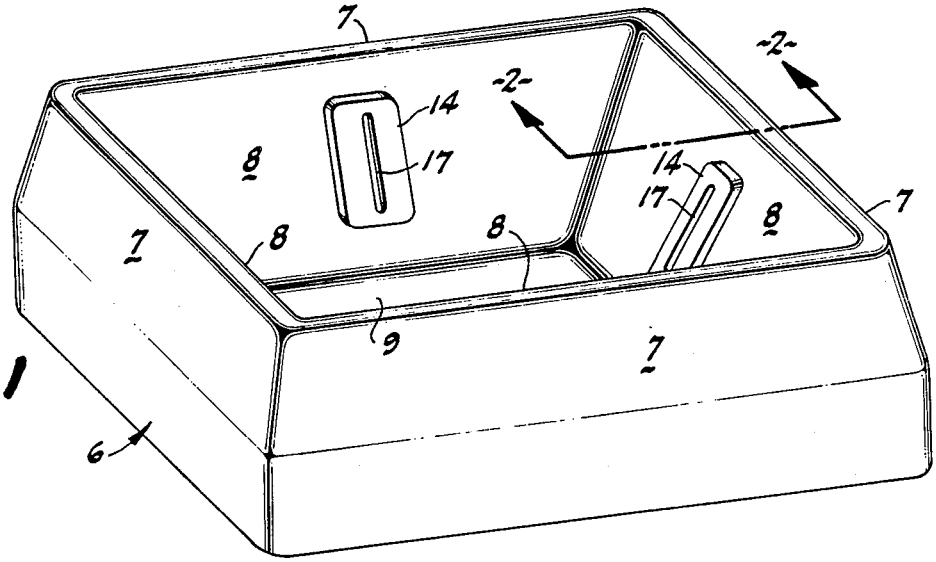
FIG. 1 is an isometric perspective view of a representative spa tank with which the structure of the invention is incorporated.

While the structure of the invention can be incorporated in a number of different ways and in connection with a number of different water retaining devices, it has with success been incorporated as shown herein. The surrounding structure is a spa tank 6 having external walls 7 merging with inclined internal walls 8 which in turn merge with a bottom 9 so that water can be retained in the tank to any desired height.

In accordance with the invention, suitable openings each having a margin 11 are formed in one or more walls 8 of the tank, and in one or more of the openings so provided there is situated a housing 12 extending from a margin 13 that abuts the inner wall 8 of the tank. The housing 12 can be left removable but preferably is secured by some adhesive to the wall 8 and is also covered by a flanged plate 14 having a bead and channel snap connection 16 with the housing 12. The housing 12 defines a vertically extending, relatively narrow slot 17 affording access between the interior of the tank and the interior of the housing.

Mounted on one of the side walls 18 of the housing is a fitting 19 having a nipple 21 extending into the housing from a flange 22 secured to the housing by an adhesive bead 23 or the like. The nipple 21 forms a journal since its outside is smoothly circular-cylindrical and at its end forms a thrust bearing since such end is smooth and planar. The fitting has a threaded portion 26 receiving a standard pipe elbow 27 having a connector 28 to a hose 29 or comparable water-supplying duct.

Comparably, the opposite wall 31 of the housing 12 carries a fitting 32 having a cylindrical nipple 33 projecting therefrom and aligned on the same transverse axis 34 as the nipple 21. The nipple 33 is substantially a duplicate of the nipple 21 and is fastened in place in the same way and is also provided with an elbow 36 having a connector 37 joined to an air tube 38 leading to a source of air under pressure.

A rotor 41 is mounted on the two nipples 21 and 33 for rotation about the axis 34. The rotor is conveniently made in two halves in mirror symmetry with each other. These are conveniently molded of plastic and are then pressed and secured together in any convenient fashion. The external meeting surfaces join in an offset step 42, as specially shown in FIG. 7. The two rotor halves when assembled form a substantially S-shaped device with oppositely directed ends. Each end lies along its own individual axis tangent to a circle concentric with the axis 34. The axes are equidistant from each other and are directed parallel to each other.

The rotor halves are formed with central hubs 43 and 44, each being internally threaded to receive a bearing nut 46 rotatable on a respective one of the nipples 21 and 33. Each hub has an end face 47 to afford an end bearing for the abutting flange 48 of the adjacent nut. The nut itself has an interior groove to receive an O-ring 49 to limit leakage.

The inner portion of each of the hubs 43 and 44 is divided by a transverse partition 51 as particularly shown in FIG. 5. The interior wall of the hub 43 on opposite sides of its partition 51 has a pair of apertures 52 and 53 therein as especially illustrated in FIG. 5. Correspondingly but in different locations, the inner wall of the hub 44 has apertures 54 and 56 therein as especially shown in FIG. 6. The apertures 52 and 53, especially as shown in FIG. 5, afford communication from the interior of the nipple 21 and the interior of the hub 43 to interior water passages 61 and 62 in the respective nozzle arms. The passage 61, for example, leads to a nozzle insert 63 having a base 64 tightly fitting into the passage 61 and converging to a throat 66 within a sleeve 67 near the end of the S-shaped nozzle and finished with a scalloped rim 69. The nozzle has a thrust face 71. A retaining interior flange 72 engages the separate nozzle and secures the nozzle in position. The assembly is initially made by inserting the nozzle into one of the outlets of one half of the S-shaped rotor and then imposing the other half of the rotor to form a complete enclosure and mounting for the nozzle itself. Thus the means that holds the two rotor halves together likewise retains the nozzle.

In an entirely similar fashion, a nozzle insert 74 is positioned in the other outlet of the S-shaped rotor. Water in the line 29 is conducted through the journal nipple 21 and through the openings 52 and 53 into the interior of the S-shaped rotor so that it discharges freely from both of the nozzles 63 and 74 in parallel paths or along axes 78 to afford sufficient reaction to cause the rotor to rotate (counterclockwise in FIG. 2) about the rotational axis 34.

In addition, the water emerging from the nozzles is also and just previously aerated. Air from the line 38 and emerging from the journal mounting or nipple 33 is released from apertures 54 and 56, as shown in FIG. 6, and flows into channels 79 and 81 extending generally parallel to the water channels 61 and 62 and connected to annular spaces 83 and 84 for flow through air openings 86 to intermix with the water flowing through the outlet passage of each nozzle. While the air may be under substantial pressure, it is also observed that the issuance of the water through the restricted orifice 66 produces a venturi effect and assists in drawing the air into the water and turbulently mixing it into an emerging, composite stream.

Figure 2:
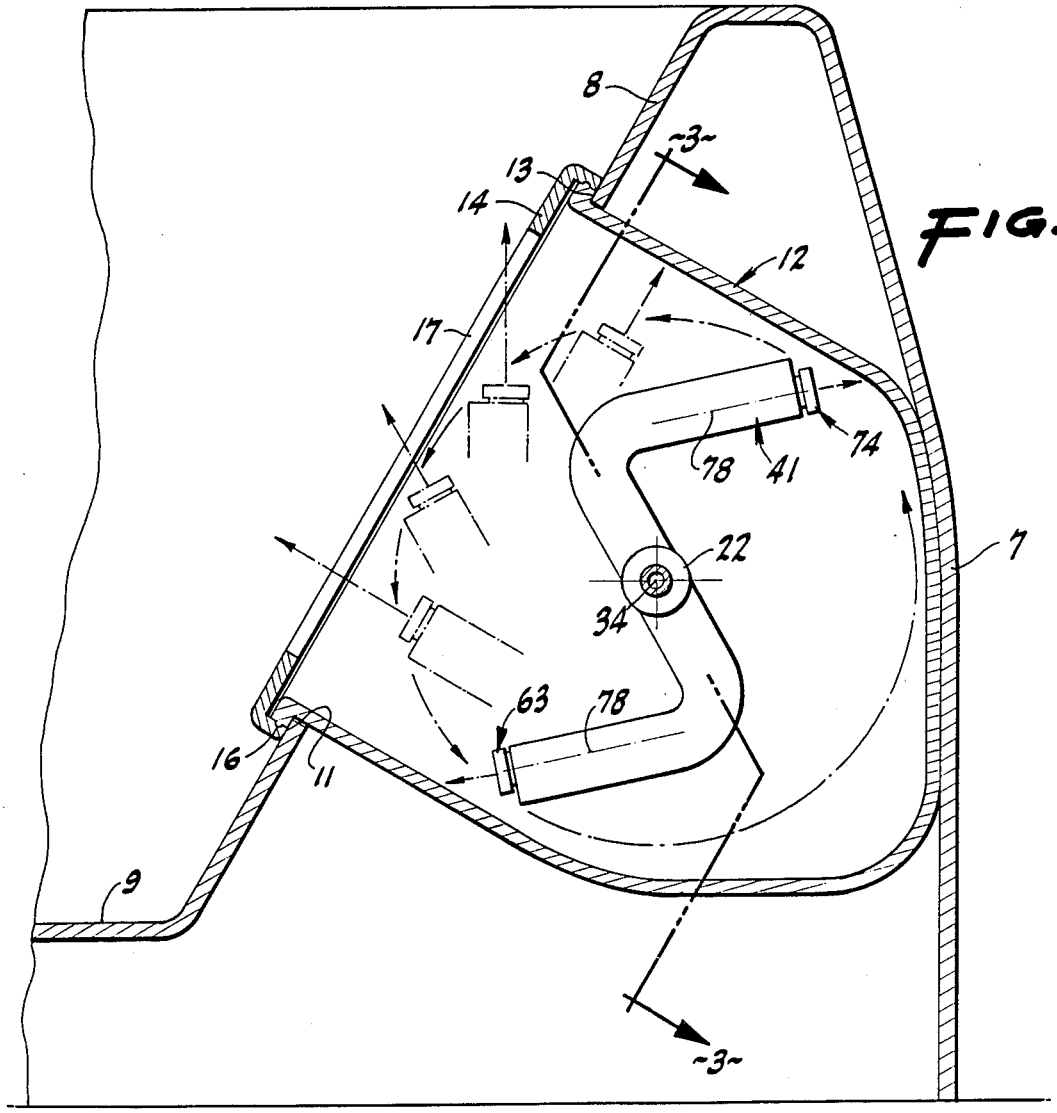
FIG. 2 is a cross-section, the plane of which is indicated by the lines 2—2 of FIG. 1.

In use, the tank 6, being appropriately supported, is substantially filled with water, usually above the level of the slit 17, and water is supplied to the conduit 29 and air under pressure is supplied to the conduit 38 simultaneously or substantially so. The reactive effect of the discharging water and air streams is to rotate the S-shaped rotor in a counterclockwise direction, as seen in FIG. 2. The composite streams emerge in through the relatively narrow slot 17 to mix with the water already in the tank. That causes aeration and agitation of the water therein and produces a welcome, intermittent massaging sensation onto one appropriately occupying the tank.

I claim:

1. An air-water nozzle for a spa tank comprising:

a. a housing extending from a wall of said tank and open to said tank between a pair of housing side walls;

b. an S-shaped rotor having opposite ends;

c. means for mounting said rotor on said side walls for rotation about a horizontal axis, said rotor mounting means including coaxial nipples extending toward each other through said housing side walls;

d. walls in said rotor defining separate coaxial chambers each communication with a respective one of said nipples;

e. means in said rotor defining separate passages extending from both of said chambers substantially to the ends of said rotor;

f. means for conducting water under pressure through said rotor mounting means into said rotor for ejection from the ends thereof;

g. means for conducting air under pressure through said rotor mounting means into said rotor for ejection from the ends thereof; and, h. means for mixing said water and said air prior to said ejection from said ends.

2. A device as in claim 1 in which said means for mounting said rotor includes thrust faces adapted to abut similar thrust faces on said rotor, said thrust faces lying in planes normal to said axis.

3. A device as in claim 1 in which one of said means for mounting said rotor on one of said side walls also serves as said means for conducting water, and another of said means for mounting said rotor on another of said side walls serves as said means for conducting air.

4. A device as in claim 1 including a nozzle inserted in one of said rotor ends, said nozzle having a central passage for water flow and a surrounding passage for air flow.

5. A device as in claim 1 including nozzles at said opposite ends for the ejection of water jets and air jets, said nozzles being directed in opposite directions tangent to a circle centered on said axis.

6. A device as in claim 1 in which said rotor is comprised of two halves meeting in a plane normal to said axis.

* * * * *